United States Patent [19]

Andrews

[11] 4,189,102

[45] Feb. 19, 1980

[54] COMMINUTING AND CLASSIFYING APPARATUS AND PROCESS OF THE RE-ENTRANT CIRCULATING STREAM JET TYPE

[76] Inventor: Norwood H. Andrews, P.O. Box 68, Moorestown, N.J. 08057

[21] Appl. No.: 904,665

[22] Filed: May 10, 1978

[51] Int. Cl.[2] ..... B02C 19/06

[52] U.S. Cl. ..... 241/5; 241/19; 241/39

[58] Field of Search ..... 241/5, 19, 39, 40

[56] References Cited

U.S. PATENT DOCUMENTS

| | | | |
|---|---|---|---|
| 697,505 | 4/1902 | Luckenbach | 241/39 |
| 2,032,827 | 3/1936 | Andrews | 241/19 |
| 2,390,678 | 12/1945 | Andrews | 241/5 |
| 2,846,151 | 8/1958 | Wehn et al. | 241/39 X |
| 2,983,453 | 5/1961 | Bourguet et al. | 241/1 |
| 3,223,333 | 12/1965 | Stephanoff | 241/5 |
| 3,425,638 | 2/1969 | Doyle et al. | 241/39 |
| 3,559,895 | 2/1971 | Fay | 241/5 |
| 4,018,388 | 4/1977 | Andrews | 241/39 |
| 4,056,233 | 11/1977 | Fay | 241/39 |

*Primary Examiner*—Robert L. Spicer, Jr.

*Attorney, Agent, or Firm*—Seidel, Gorda, Goldhammer & Panitch

[57] ABSTRACT

Comminuting and classifying apparatus of the re-entrant circulating stream jet type includes a vortex chamber and jet means. The feed means includes a central conical recess in one wall of the chamber, a coaxial circular chamber opening into said recess and means to direct the material and gaseous carrier fluid into said chamber tangential to the wall of the chamber so that the material and carrier fluid is added to the vortex with a rotative velocity. The apparatus may also be provided with means for jet and anvil comminution of feed material and/or recirculating material. The chamber may include an annular shoulder for skimming undesirable particles in the feed material.

21 Claims, 7 Drawing Figures

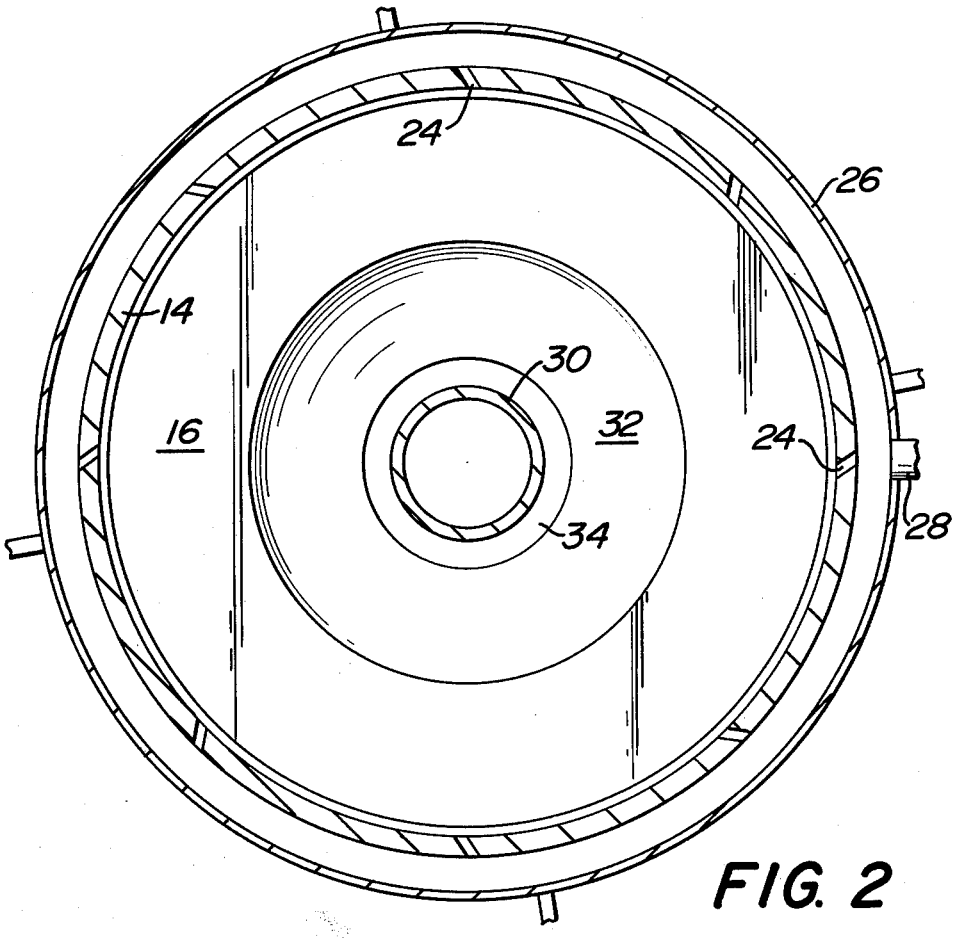
FIG. 2
FIG. 4
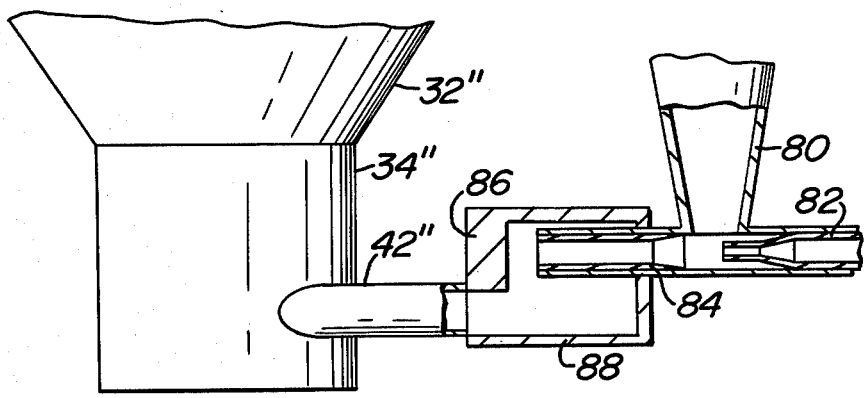

COMMINUTING AND CLASSIFYING APPARATUS AND PROCESS OF THE RE-ENTRANT CIRCULATING STREAM JET TYPE

BACKGROUND OF THE INVENTION AND DESCRIPTION OF THE PRIOR ART

The present invention relates to comminuting and classifying apparatus. More particularly, it relates to a comminuting and classifying mill of the re-entrant circulating stream jet type commonly referred to as "Micronizers". The Micronizer is the oldest and most widely used of the re-entrant circulating stream jet grinding mills.

This type of grinding mill is described in detail in U.S. Pat. No. 2,032,827 issued Mar. 3, 1936. The basic mill includes a vortex chamber comprising an annular peripheral wall closed by two opposed lateral walls. In its preferred form, the vortex chamber is formed so that the axial length of the peripheral wall is only a small fraction of the diameter of the chamber. The peripheral wall is surrounded by a manifold through which high pressure gas is supplied to a plurality of gaseous fluid nozzles positioned around the peripheral wall and angled so that the gaseous stream issuing from them propels the fluid with both a forward and a transverse component of movement relative to the axis of the chamber. Conventionally, the material to be comminuted is fed into the chamber by jet and venturi apparatus located near the periphery of the chamber.

The introduction of feed material into the Micronizer has been a continuing problem since it was first put into commercial use. These problems are discussed in some detail in U.S. Pat. No. 4,018,388 issued Apr. 19, 1977. The principal problems involve the distribution of the feed material in the proper zone and its effect upon the whirling vortex of fluid within the chamber.

Jet feeding means are mainly concerned with providing a more uniform distribution of feeding the material into the grinding zone although they do have the advantage of giving the feed material and its carrier fluid an initial velocity. They are principally preferred for comminuting various types of free-flowing materials because damp, viscous, or precipitate materials frequently tend to clog the feed apparatus.

The problem with screw-feeding material into the chamber arises from the fact that the circulating gases within the chamber have little or no momentum. The introduction of feed material in a static condition results in a localized shock to the conformity of flow of the circulating gases as they try to accelerate the feed material from the static condition to the velocity of the circulating load in the mill.

The apparatus described in U.S. Pat. No. 4,018,388 has been a commercially successful solution to the problem of improving the distribution of the feed material as it is introduced into the re-entrant circulating stream jet grinding mill. As described in the patent, a conical recess is provided in the side wall opposite the outlet and the feed material is axially introduced into the recess so that it disperses from the apex of the cone radially and axially toward the classification zone of the circulating gases. The feed material becomes entrained with the circulating gases, the vortex of which extends into the conical recess. Thus, the feed material mixes with the circulating gases and there is a uniform distribution of the feed material into the classification zone.

Although the mill described in U.S. Pat. No. 4,018,388 is indeed a successful improvement in feed distribution in this type of mill, the fact remains that the fluid gas and entrained feed material is directed radially and axially in a random manner with no circulating direction. This means that the energy necessary to give it a high velocity whirling effect must be extracted from the classifying vortex. Indeed, the patent expressly points out that it uses the circular velocity of the gases in the classification zone to accelerate the feed material to a velocity in excess of the circulating load adjacent the inner periphery of the mill. See U.S. Pat. No. 4,018,388, column 3, lines 33–48.

The present invention is therefore concerned with providing all of the benefits and advantages of the re-entrant circulating stream jet grinding mill described in U.S. Pat. No. 4,018,388 without extracting energy from the classifying vortex circulating within the chamber. Thus, it is one of the objects of the present invention to feed material with its carrier gas so as to provide it with a rotative velocity which will be transmitted to the classifying vortex thereby supplementing its velocity rather than extracting energy from it.

SUMMARY OF THE INVENTION

The present invention is concerned with comminuting and classifying apparatus with a re-entrant circulating stream jet type and means for introducing feed and recirculating material into such apparatus. In accordance with the present invention, the material is not only uniformly distributed into the classification zone, it is also accomplished by supplementing rather than extracting energy from the circulating vortex of gas and material within the mill chamber. This is accomplished by providing a circular chamber coaxial with the opening into the recess described and shown in U.S. Pat. No. 4,018,388. The feed material and its carrier fluid is directed into the circular chamber tangential to the wall thereof so that the resultant circular velocity of the carrier fluid and feed material is transmitted to the classifying vortex in the recess in a manner so as to supplement its velocity.

Also in accordance with the present invention, there is provided a jet and anvil comminuting means positioned and arranged in such a manner that the discharge from the anvil chamber tangentially enters the feed chamber. The material comminuted by the jet and anvil grinding means can be feed material and/or a portion of the load in the mill which is extracted through a duct connected adjacent its periphery.

In yet another embodiment, the present invention can be used to remove undesirable contaminants from the material being comminuted. In this embodiment, an annular shoulder is provided at the junction of the feed chamber and conical recess. Venting means are provided to remove material diverted by the shoulder.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 2 is a sectional view taken on line 2—2 of FIG. 1.

FIG. 4 is a partial sectional view of an alternate jet and anvil feeding means for the mill of FIG. 1.

Figure 1:
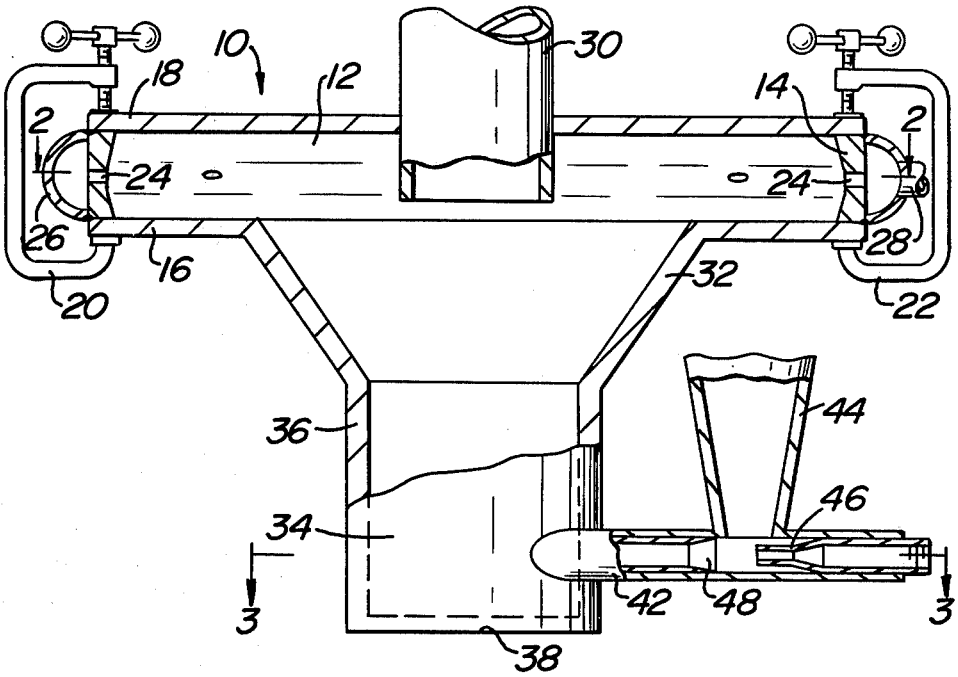
FIG. 1 is a sectional view of a mill embodying the present invention.

Referring to the drawings in detail wherein like numerals indicate like elements, there is shown in FIG. 1 a comminuting and classifying apparatus of the re-entrant circulating stream jet type designated generally as 10. The apparatus 10 includes a circular comminuting chamber 12 defined by the annular peripheral wall 14 and the opposed lateral walls 16 and 18. The walls 14, 16 and 18 are removably held together by C-clamps 20 and 22 so that the apparatus 10 may be readily disassembled and cleaned.

As best shown in FIG. 2, a plurality of nozzles 24 are spaced around the entirety of peripheral wall 14 at an angle relative to the radius of chamber 12 so that fluid jet streams emitted from them move with both a forward and a radial component of direction. Thus, as is known in the art, the nozzles create the circulating vortex within the chamber 12.

Surrounding the annular peripheral wall 14 is an annular manifold 26 connected to a source of gaseous fluid under pressure (not shown) through the duct 28. An outlet duct 30 for comminuted material extends through the wall 18 and its opening is preferably coaxial with the axis of the circular chamber 12.

The lateral wall 16 is provided with a central recess 32 which as shown is frusto-conical in shape. The larger diameter of the recess 32 is coplanar with the lateral wall 16 and its smaller diameter is remote from it as shown. The smaller diameter or apex of the recess 32 opens into the feed chamber 34 which as shown includes cylindrical wall 36 and is closed by end wall 38. Although the feed chamber 34 is shown in FIG. 1 as being cylindrical, it should be understood that it can take other shapes as explained and illustrated below. But chamber 34 should have a circular cross-section or otherwise be in the form of a regular surface of revolution. Moreover, the axis of the wall 36 is preferably coaxial with the axis of the recess 32.

Figure 3:
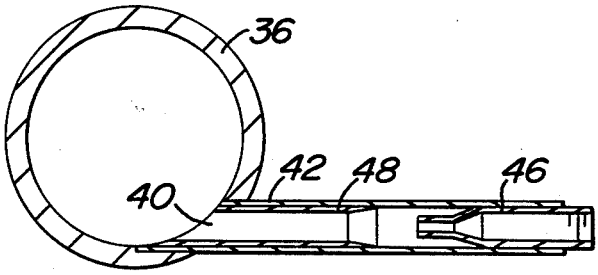
FIG. 3 is a sectional view taken on line 3—3 of FIG. 1.

As best illustrated in FIG. 3, the chamber 34 is provided with an inlet 40 which extends through the wall 36 in such a manner that material fed through the feed duct 42 flows into the chamber 34 tangentially with the wall 36.

The feed material is inserted into the apparatus 10 through the funnel 44 and is entrained by the carrier fluid from the nozzle 46 which injects the material into the venturi passage 48, where it is accelerated and propelled through the duct 42 and inlet 40 into the chamber 34. The nozzle 46 is connected to a source of carrier fluid under pressure (not shown).

The diameter of the feed chamber 34 must be of sufficient dimension in relation to the total amount of carrier gas and material tangentially directed into it that it will enter the apex of the recess 32 with a greater rotational direction than upward thrust. By way of example but not limitation, it has been determined that in most applications an axial length equal to the diameter of feed chamber 34 is satisfactory. Further, the diameter must be considered in relation to the recess 32. In this regard, satisfactory results are obtained when the diameter of feed chamber 32 is approximately one-half ($\frac{1}{2}$) the large diameter of recess 32. As explained below, some variation is required when the feed chamber is designed to remove undesirable contaminants from the material or when the carrier gas includes recirculating material drawn from the apparatus.

The carrier fluid and entrained material are constrained by wall 36 to whirl around the inside of feed chamber 34. The material and carrier fluid also move axially with a high velocity helical action toward and into the recess 32 where it transfers its rotary energy to the classifying vortex of the apparatus itself. In this manner, the carrier gas and entrained material add energy to the circulating vortex in the classifying zone. As pointed out in U.S. Pat. No. 4,018,388, the rotary velocity in the classifying zone exceeds the velocity of the circulating load adjacent the inner periphery of the mill. Moreover, the axial introduction of the material into the apex of the recess, centrally located in relation to the periphery of the apparatus, permits the material to be dispersed radially and axially resulting in a more uniform distribution of the feed material into the classification zone.

Figure 5:
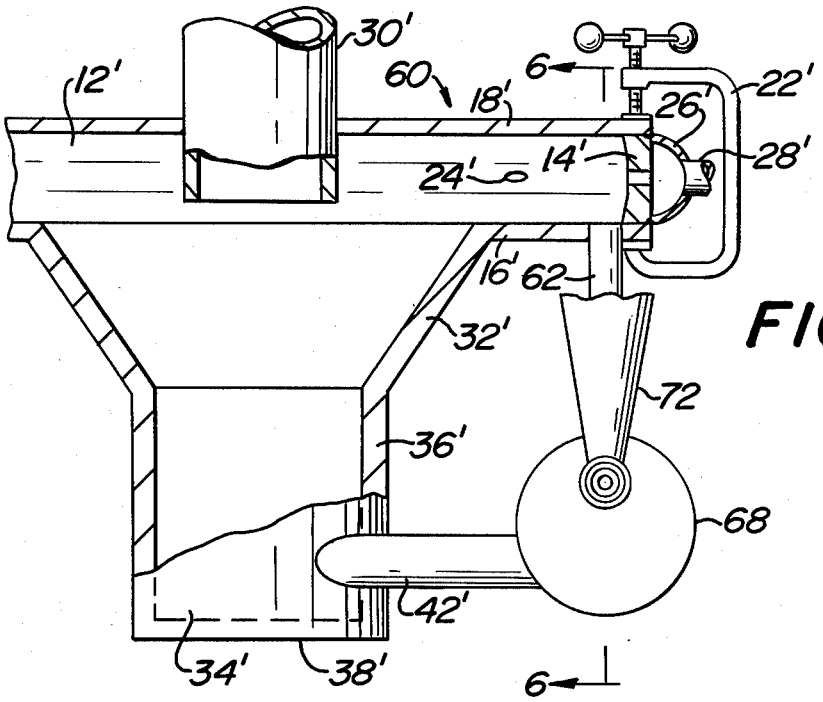
FIG. 5 is a sectional view of another embodiment of the present invention showing the mill with apparatus to recirculate the load through a jet and anvil comminuting means.
Figure 6:
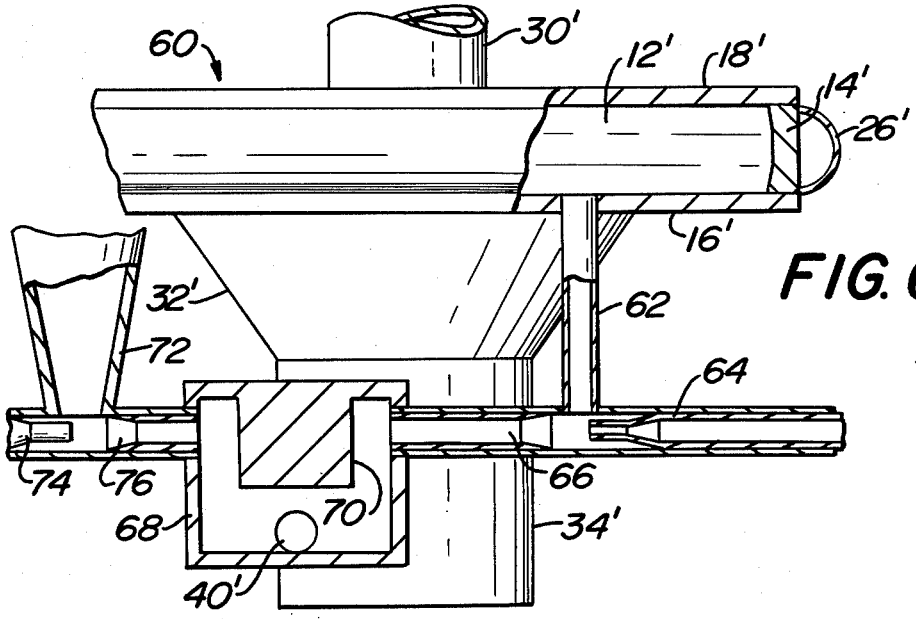
FIG. 6 is a sectional view taken on line 6—6 of FIG. 5.

For a number of materials, it is advantageous to remove a portion of the circulating load and recirculate that material in the same manner as feed material. Referring to FIGS. 5 and 6, there is shown another embodiment of the present invention by which this advantage may be accomplished. The structural elements of the embodiment of FIGS. 5 and 6 which are the same as the structural elements of the embodiment shown in FIGS. 1–3 are indicated by primed numbers but their function is not again described so as to avoid unnecessary repetition.

The mill 60 is a comminuting and classifying apparatus of the re-entrant circulating stream jet type. It differs from the mill 10 in that it is provided with a means to remove a portion of the circulating load from the mill and recirculate that portion through the feed chamber 34' together with the feed material. As shown, a recirculation duct 62 opens into the chamber 12' adjacent to the peripheral wall 14'. Duct 62 conducts load material and gaseous fluid to a point adjacent the exit end of nozzle 64 which is connected to a source of gaseous fluid under pressure (not shown). In a manner known in the art, the high velocity gas exiting from nozzle 64 entrains the load material from recirculating duct 62 and it is accelerated in the venturi 66. The entrained material is therefore driven at high velocity into the impact chamber 68.

Impact chamber 68 is provided with an anvil 70 whose surface is a hardened material such as tungsten carbide. This provides an effective jet and anvil grinding means for additional comminution of the recirculated material.

The feed material is inserted through funnel 72 and is entrained by the gaseous fluid under pressure from nozzle 74 which injects the material into the venturi 76. Venturi 76 accelerates the material and propels it against the anvil 70 where it undergoes primary comminution.

The comminuted feed material and comminuted recirculated material rebound from the anvil 70 and flow together with the gaseous fluid through feed duct 42' into feed chamber 34'. As described above, in respect to feed mill 10, the material enters feed chamber 34' at a high velocity and generally tangential to the wall 36' so that it acquires a rotative velocity and commences whirling helically toward and into the recess 32'.

It has been determined that for operation of a mill where a portion of the load is recirculated, the diameter of the feed chamber 34' should be slightly less than the largest diameter of the frusto-conical recess 32'. This dimension is satisfactory for a majority of the comminution process, particuarly where two-fifths (2/5) of the total gas volume used in the operation of the mill is supplied to the feed chamber 34'. In general, this gas comprises the carrier fluid for the original feed material plus the gas drawn through recirculating duct 62, plus the gas issuing from nozzle 64.

It should also be understood that primary jet and anvil comminution of the feed material as illustrated in FIGS. 5 and 6 is not required for use within a mill that recirculates a portion of the load. The feed material can be fed directly into the feed chamber as in the embodiment of FIGS. 1–3.

In addition, it may under some circumstances be advantageous to provide primary comminution of the feed material only. This is illustrated in FIG. 4 wherein the mill is the re-entrant circulating stream jet type and may or may not, as desired, recirculate a portion of the load without jet and anvil comminution.

In the embodiment of FIG. 4, the elements which are the same as those of the embodiment of FIGS. 1–3 are shown with double primed numbers but to avoid unnecessary repetition, they are not otherwise described.

As shown in FIG. 4, the feed material is inserted through funnel 80 and is entrained by gaseous fluid under pressure from the nozzle 82. Nozzle 82 injects the material into the venturi 84 where it is accelerated and propelled at a high velocity against the anvil 86. Anvil 86 is mounted within the impact chamber 88 and is provided with a hardened surface, such, as by way of example, tungsten carbide. The comminuted feed material flows from impact chamber 88 through feed duct 42' into feed chamber 34'. It is injected at a high velocity into feed chamber 34'' tangentially to the wall and flows into the recess 32'' in the manner heretofore described.

If the feed material is damp when using jet and anvil, it is desirable to use a heated gas, such as superheated steam. In the operation of a mill, such as the mill 60' shown in FIGS. 5 and 6, there will be more recirculated material than original feed material. Moreover, the amount of fluid energy required to impact the recirculated material against the anvil 70 is necessarily more than that required to inject the original feed material. As a result, there is a considerable drying effect resulting from the merging of the dry fluid entrained recirculating material with the damp feed material.

Some damp feed materials tend to build up on the anvil and then drop off in lump form thereby clogging the feed duct 42'. When these conditions occur, it is desirable to eliminate the anvil 70 and have the two gaseous streams impact each other as is known in the art and was first described in U.S. Pat. No. 697,505 issued Apr. 15, 1902.

It should be understood that venting load material from a re-entrant circulating stream jet mill is per se known. See, for example, U.S. Pat. No. 2,032,827, particularly FIG. 28 and page 10, column 2, lines 56–61. U.S. Pat. No. 2,846,151 shows a mill with a slot at the periphery for discharge of coarse material. U.S. Pat. No. 2,390,678 describes a successful method for periodically venting with interrupted feed. This latter patent makes a very selective cut of undesirable material from the main body of material.

It should also be noted that steam operated Micronizers and other re-entrant circulating stream jet type mills have been used to remove flint particles from china clay by peripheral venting. Although this method of removing undesirable flint has been commercially accepted, the apparatus discharges more clay with the flint than is considered to be optimum.

The circulating load concentrated at the periphery of the chamber 12' is the material having the highest specific gravity, the least grindability and the coarsest fractions being comminuted. Because of the axial restriction at the periphery of re-entrant circulating stream jet mills, such as Micronizers, the turbulent circulating stream of material has considerable radial extent. This is necessary so that sufficient material will circulate in front of the jets issuing from the nozzles for them to pick up the material adjacent the peripheral wall and drive it through the circulating steam for impact grinding. Because of this radial depth of material, prior art peripheral venting means have been unable to make a very selective cut unless the feeding of material is stopped periodically to allow the product to be selectively removed leaving the contaminants in the mill as described in U.S. Pat. No. 2,390,678. Still further, this process has proved rather difficult to automate on large, high temperature steam mills resulting in a non-uniform product. Stated otherwise, a uniform rate of material feeding is a known condition for obtaining uniform product size in re-entrant circulating stream jet mills.

As previously indicated, one of the objects of the present invention is to provide new means for removing undesirable contaminants from the material undergoing comminution. The apparatus shown in FIG. 7 is specifically directed to removing undesirable contaminants from the material undergoing comminution without removing an unacceptable quantity of material which ultimately would become a desirable product when further comminuted.

Figure 7:
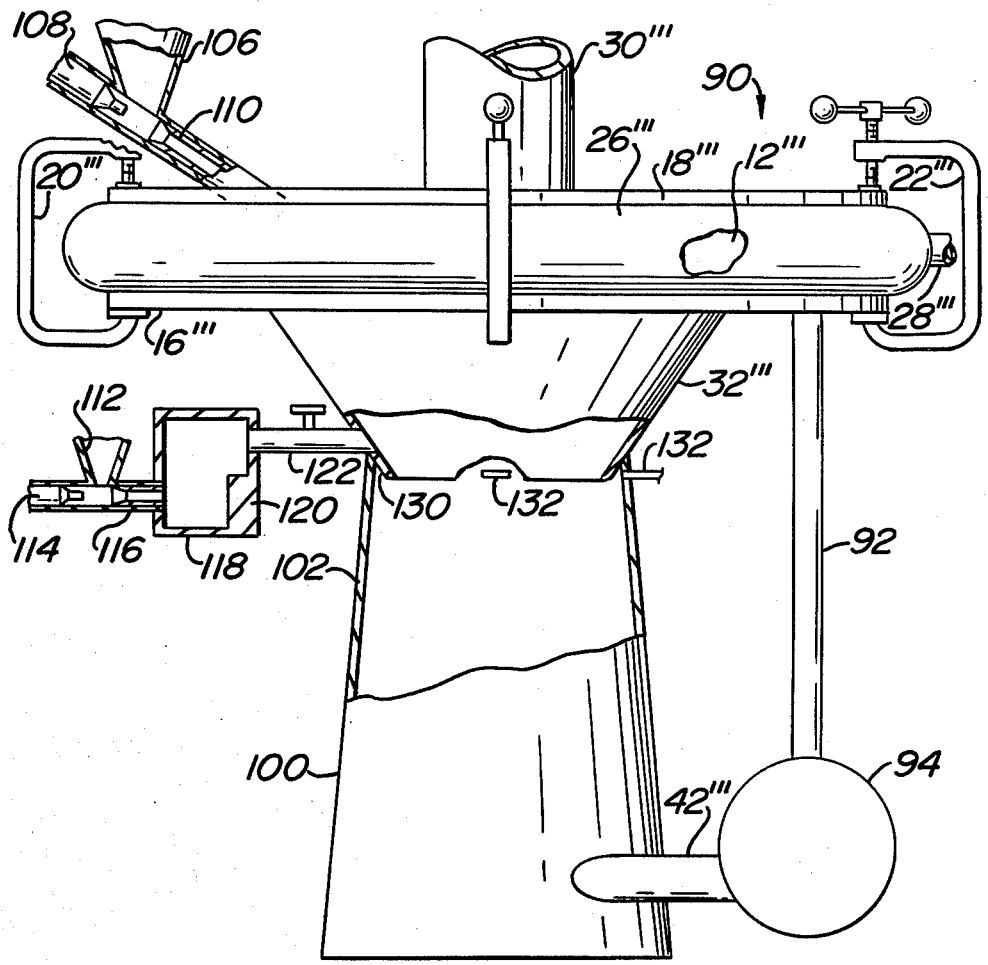
FIG. 7 is a partial sectional view of an alternative mill embodying the present invention.

The mill illustrated in FIG. 7 is a comminuting and classifying apparatus of the re-entrant circulating stream jet type and is generally indicated by the numeral 90. To avoid unnecessary redundant description, elements of the mill 90 which are the same as elements of the mill 10 are indicated by triple primed numbers.

As in the case of the mill 60 illustrated in FIGS. 5 and 6, the mill 90 is provided with means for recirculating a portion of the load. This recirculating means includes the recirculating duct 92 which conducts load material from chamber 12''' to the impact chamber 94 where it undergoes jet and anvil comminution as described in relation to the mill 60.

In the same manner, material is fed from funnel 96 into the impact chamber 94. Combined recirculating material and feed material flow through feed duct 42''' into the feed chamber 100. It enters feed chamber 100 tangentially to the wall 102 and thus is constrained to flow in the form of a helix through the chamber 100 into recess 32''' as heretofore described.

In the mill 90, the entrance to the recirculating duct 92 is spaced radially inward from the peripheral wall. By way of comparison, the entrance to the duct 62 of the mill 60 is adjacent the peripheral wall 14'. This inward spacing of the entrance to the duct 92 permits a finer average comminution in the mill proper and reduces the percentage of desirable material that is vented from the mill together with the undesirable material. For the same reason, it may be preferable to initially feed material directly into the chamber 12''' as is conventionally done in re-entrant circulating stream jet mills. For this purpose, the feed material is inserted through the funnel 106 and is entrained by gaseous carrier fluid under pressure from the nozzle 108 which injects the material into the venturi 110 and through the lateral wall 18''' into the chamber 12'''.

Under certain conditions, such as for example the feeding of damp materials, it is desirable to introduce the feed material tangentially into the apex of the recess 32'''. For this purpose, the apparatus 90 is provided with a funnel 112, nozzle 114 and venturi 116 which accelerates the feed material into the impact chamber 118 against the anvil 120 in the manner described in detail in the embodiment of FIG. 4. The feed material is comminuted in impact chamber 118 and flows through duct 122 into the recess 32''' adjacent the apex thereof.

As shown in FIG. 7, the feed chamber 100 differs from the previously described feed chambers in that the wall 102 is frustro-conical with the smaller diameter or apex thereof joining the apex of the recess 32'''. However, the apex of the conical wall 102 is slightly larger than the apex of the recess 32''' so that the wall of recess 32''' overhangs the interior of feed chamber 100 and forms an annular shoulder 130 which functions to divert undesirable particles.

The undersirable material is vented from the space between the top of wall 102 and annular shoulder 130 through one or more curved slots 132 formed in the top of wall 102 and connected to appropriate exhaust means (not shown).

The operation of the mill 90 is somewhat similar to the operation of the mill 60. Material discharged through recirculating duct 92 is conveyed into impact chamber 94 for jet and anvil comminution. From impact chamber 94, the material is carried through duct 42''' into feed chamber 100.

It has been found that the conical shape of feed chamber 100 and the shoulder 130 is particularly useful for the removal of small quantities of undesirable particles such as flint from china clay or pyrites (which contain undesirable sulfur) or ash producing shale from coal. Still further, it is preferable that the height of feed chamber 100 be approximately twice its largest diameter. For some material, an even greater ratio of height to diameter may be desirable.

Since the recirculating material enters feed chamber 100 at or adjacent to the bottom and tangentially to the wall 102 thereof, the material will spread over the considerable volume of the chamber 100 as it rises axially in a rotational manner. As a result, there is very little radial depth of material adjacent the wall 102 such as when venting adjacent the periphery of the mill as shown in FIG. 5.

As the gaseous fluid and entrained material converge axially due to the conical shape of the feed chamber 100, a sorting such as when venting adjacent the periphery of the mill as shown in FIG. 7.

The sorting effect is obtained because the higher specific gravity and larger particles concentrate as a thin layer against the wall 102 while the finer fractions spread radially inward toward the axis of the mill and enter the apex of recess 32'''.

It follows that the radial dimension of the shoulder 130 must be limited to prevent venting too much desirable material together with the contaminants. By properly dimensioning the radial extent of shoulder 130, a very selective removal of contaminants is possible. In general, the larger the mill, the greater the radial extent of the shoulder 130. Thus, large mills designed for several ton per hour of material throughput and which have a heavy percentage of contaminants will require a shoulder of greater radial extent than smaller mills with relatively little throughput and which have a lsser quantity of contaminants in the feed material. By way of example but not limitation, a 24 inch mill having a throughput of 1 ton per hour of feed material having 8% contaminant was found to operate in a satisfactory manner with an annular shoulder of three-eighths ($\frac{3}{8}$) of an inch.

The present invention may be embodied in other specific forms without departing from the spirit or essential attributes thereof and, accordingly, reference should be made to the appended claims, rather than to the foregoing specification as indicating the scope of the invention.

I claim:

1. Comminuting and classifying apparatus comprising a generally circular vortex chamber including an annular peripheral wall and first and second opposed lateral walls, said annular peripheral wall including a plurality of gaseous fluid nozzles positioned to propel gaseous fluid with both a forward and a transverse component of direction of movement relative to the axis of said chamber to form a fluid vortex in said vortex chamber, a material product outlet in one of said lateral walls, a recess having a circular cross-section in the central portion of the other of said lateral walls, material feed means for said apparatus including a feed chamber closed at one end and opening into the apex of the recess at its other end, said feed chamber including a wall in the form of a regular surface of revolution coaxial with said recess, material inlet means for said feed chamber positioned to propel gaseous carrier fluid and material into said chamber generally tangential to the wall of said feed chamber so that said material and its carrier fluid flow in the manner of a vortex in said chamber and are added to the fluid vortex in said recess and vortex chamber with a supplemental rotative velocity, means to connect said material inlet to a source of material, and means to connect said nozzles and said material inlet to a source of gaseous fluid under pressure.

2. Comminuting and classifying apparatus in accordance with claim 1 wherein said means to connect said material inlet to a source of material includes means to connect said inlet to receive feed material.

3. Comminuting and classifying apparatus in accordance with claim 1 wherein said means to connect said material inlet to a source of material includes means to connect said inlet to receive recirculating material.

4. Comminuting and classifying apparatus in accordance with claim 3 wherein said means to connect said material inlet to receive recirculating material includes jet and anvil comminuting means.

5. Apparatus in accordance with claim 2 wherein said means to connect said material to a source of feed material includes jet and anvil comminuting means.

6. Comminuting and classifying apparatus in accordance with claim 1 wherein said recess is frusto-conical in configuration with the smaller diameter portion of said recess being remote from said other lateral wall.

7. Comminuting and classifying apparatus in accordance with claim 1 wherein said feed chamber is a cylinder.

8. Comminuting and classifying apparatus in accordance with claim 1 wherein an annular material diverting shoulder is positioned adjacent the junction of said feed chamber and recess for selectively diverting particles of material adjacent the chamber wall to a vent opening in said apparatus, and venting means for venting said particles of material from said apparatus.

9. Comminuting and classifying apparatus in accordance with claim 8 wherein said feed chamber is frusto-conical with the apex thereof adjoining an opening into said recess.

10. Comminuting and classifying apparatus in accordance with claim 8 wherein said recess is generally frusto-conical with the samller diameter portion of said recess being remote from said wall, and said chamber is frusto-conical with the apex thereof opening into said recess.

11. Comminuting and classifying apparatus in accordance with claim 1 wherein said recess is frusto-conical in configuration with the smaller diameter portion of said recess being remote from said other wall, and the wall of said feed chamber is cylindrical.

12. Comminuting and classifying apparatus in accordance with claim 11 wherein the diameter of said feed chamber is approximately one-half the larger diameter of said frusto-conical recess where said recess opens into said circular vortex chamber.

13. Comminuting and classifying apparatus in accordance with claim 3 wherein said recess is frusto-conical in configuration with the smaller diameter of said recess being remote from said other wall and the larger diameter defining the opening of said recess into said circular vortex chamber, the wall of said feed chamber is cylindrical, and the diameter of the wall of said feed chamber is slightly less than said larger diameter of said frusto-conical recess.

14. Comminuting and classifying apparatus comprising a generally circular vortex chamber including an annular peripheral wall and first and second opposed lateral walls, said annular peripheral wall including a plurality of gaseous fluid nozzles positioned to propel gaseous fluid with both a forward and a radial component of direction of movement relative to the axis of said chamber to form a fluid vortex having comminuting and classifying zones in said chamber, a material product outlet centrally positioned in one of said walls, a generally frusto-conical recess having a circular cross-section in the central portion of the other of said walls, material feed means for feeding material into the classifying zone of said vortex with a rotative velocity that equals or supplements the velocity of the gaseous fluid and material flowing in said classifying zone, said material feed means including a feed chamber closed at one end and opening into the apex of the recess at its other end, said feed chamber including a cylindrical wall coaxial with said recess, material inlet means for said feed chamber positioned to propel gaseous fluid and material into said feed chamber generally tangential to the wall of said feed chamber so that said material and its carrier fluid flow in the manner of a vortex within said feed chamber and are added to the fluid vortex in said recess and vortex chamber with a supplemental rotative velocity, means to connect said material inlet to a source of material, and means to connect said nozzles and material inlet to a source of gaseous fluid under pressure.

15. Comminuting and classifying apparatus in accordance with claim 14 wherein the ratio of the length to the diameter of said feed chamber is such that the gaseous carrier fluid and material enter the recess with a greater rotational velocity than axial velocity.

16. Comminuting and classifying apparatus in accordance with claim 15 wherein the diameter of said feed chamber is approximately equal to the axial length of said feed chamber.

17. In a process for comminuting and classifying material in a re-entrant circulating stream jet type mill wherein said mill includes a generally circular vortex chamber including an annular peripheral wall and first and second opposed lateral walls, said annular peripheral wall having a plurality of gaseous fluid nozzles positioned to propel gaseous fluid with both a forward and a transverse component of direction of movement relative to the axis of the chamber to form a comminuting and classifying fluid vortex in said vortex chamber, a material product outlet in one of the walls of said vortex chamber, a recess having a circular cross-section in the central portion of the other of the walls of said chamber, the improvement comprising uniformly feeding material into the classifying zone of the vortex within said vortex chamber with a rotative velocity that is equal to or supplements the velocity of fluid and material flowing in the classifying zone, comprising the steps of propelling gaseous fluid and material tangential to the cylindrical wall of a feed chamber closed at one end and opening into the apex of the recess at the other end so that material and its carrier fluid flow in the manner of a vortex in said chamber and are added to the fluid vortex in said recess and vortex chamber with a supplemental rotative velocity.

18. In a process for comminuting and classifying material in accordance with claim 17 wherein material and gaseous fluid is recirculated from said vortex chamber and fed back by propelling the same into said feed chamber.

19. In a comminuting and classifying process in accordance with claim 18 the step of comminuting the recirculated material using a jet and anvil.

20. Comminuting and classifying apparatus comprising a generally circular vortex chamber including an annular peripheral wall and first and second opposed lateral walls, said annular peripheral wall including a plurality of gaseous fluid nozzles positioned to propel gaseous fluid with both a forward and a radial component of direction of movement relative to the axis of said chamber to form a fluid vortex having comminuting and classifying zones in said chamber, a material product outlet centrally positioned in one of said walls, a material feed means in the other of said walls for feeding material into the classifying zone of said vortex with a rotative velocity that equals or supplements the velocity of the gaseous fluid and material flowing in said classifying zone, said material feed means including a feed chamber closed at one end and open into the vortex chamber at its other end, said feed chamber including a wall in the form of a regular surface of revolution, said feed chamber being generally centrally positioned in said other wall, material inlet means for said feed chamber positioned to propel gaseous fluid and material into said feed chamber generally tangential to the wall of said feed chamber so that material and its carrier fluid flow in the manner of the vortex within said feed chamber and are added to the fluid vortex in said vortex chamber with a supplemental rotative velocity, means to connect said material inlet to a source of material, and means to connect said nozzles and material inlet to a source of gaseous fluid under pressure.

21. Comminuting and classifying apparatus in accordance with claim 20 wherein the ratio of the length to the diameter of said feed chamber is such that the gaseous fluid and material enter the vortex chamber with a greater rotational velocity than axial velocity.

* * * * *